US009700938B2

(12) United States Patent
Witschas et al.

(10) Patent No.: US 9,700,938 B2
(45) Date of Patent: Jul. 11, 2017

(54) CASTING/ROLLING INSTALLATION AND METHOD FOR DISMANTLING AND INSTALLING ROLLS IN A REDUCING STAND OF THE CASTING/ROLLING INSTALLATION

(71) Applicant: SMS group GMBH, Düsseldorf (DE)

(72) Inventors: Eberhard Witschas, Kreuztal (DE); Jürgen Heppelmann, Warstein (DE)

(73) Assignee: SMS GROUP GMBH, Düsseldorf (DE)

( * ) Notice: Subject to any disclaimer, the term of this patent is extended or adjusted under 35 U.S.C. 154(b) by 0 days.

(21) Appl. No.: 14/766,650

(22) PCT Filed: Jan. 8, 2014

(86) PCT No.: PCT/EP2014/050178

§ 371 (c)(1),
(2) Date: Aug. 26, 2015

(87) PCT Pub. No.: WO2014/108413

PCT Pub. Date: Jul. 17, 2014

(65) Prior Publication Data

US 2015/0343524 A1 Dec. 3, 2015

(30) Foreign Application Priority Data

Jan. 14, 2013 (DE) ..... 10 2013 200 438
Nov. 29, 2013 (DE) ..... 10 2013 224 633

(51) Int. Cl.
*B22D 11/12* (2006.01)
*B22D 11/14* (2006.01)
(Continued)

(52) U.S. Cl.
CPC ..... *B22D 11/1206* (2013.01); *B21B 1/463* (2013.01); *B21B 31/103* (2013.01);
(Continued)

(58) Field of Classification Search
CPC ..... B22D 11/12; B22D 11/1206; B22D 11/14; B22D 11/147; B22D 47/00; B21B 1/463; B21B 31/103
(Continued)

(56) References Cited

U.S. PATENT DOCUMENTS 1,833,376 A 11/1931 Simmons
3,396,566 A 8/1968 Alsop et al.
(Continued)

FOREIGN PATENT DOCUMENTS

CN 102015154 A 4/2011
DE 693224 C 7/1940
(Continued)

OTHER PUBLICATIONS

The Patent Office of the People's Republic of China, Feb. 28, 2017; Notification of Second Office Action.

*Primary Examiner* — Kevin P Kerns
(74) *Attorney, Agent, or Firm* — Lucas & Mercanti, LLP; Klaus P. Stoffel

(57) ABSTRACT

A casting/rolling installation for producing hot-rolled strip. In order to save investment costs for the roll changing device in a corresponding installation with two parallel casting lines, without a roll change taking place in the process in a less operationally reliable and more complicated manner, the roll changing device is configured in the form of a rotary table and arranged in the intermediate space between the two casting lines.

20 Claims, 4 Drawing Sheets

(51) Int. Cl.
*B22D 47/00* (2006.01)
*B21B 1/46* (2006.01)
*B21B 31/10* (2006.01)

(52) U.S. Cl.
CPC ..... *B22D 11/147* (2013.01); *B22D 47/00* (2013.01); *Y10T 29/49547* (2015.01)

(58) Field of Classification Search
USPC ..... 164/417, 424, 476; 29/527.7, 895.1; 72/226, 239
See application file for complete search history.

(56) References Cited

U.S. PATENT DOCUMENTS 5,009,096 A 4/1991 Mäenpää et al.
5,335,713 A * 8/1994 Hoppmann et al. .... B21B 1/466 164/269
5,548,882 A 8/1996 Windhaus et al.
5,829,117 A * 11/1998 Okawa et al. ..... B21B 15/0085 164/459
6,837,090 B2 1/2005 Svejkovsky
9,120,147 B2 9/2015 Ondrovic et al.
2009/0236068 A1* 9/2009 Ondrovic et al. . B22D 11/0622 164/463

FOREIGN PATENT DOCUMENTS

DE 851941 C 10/1952
DE 1245298 B 7/1967
DE 1527622 A1 1/1970
DE 3941374 A1 7/1990
DE 10200442 C1 7/2003
GB 526426 A 9/1940
JP 09267109 A 10/1997
WO 9300179 A1 1/1993

* cited by examiner

CASTING/ROLLING INSTALLATION AND METHOD FOR DISMANTLING AND INSTALLING ROLLS IN A REDUCING STAND OF THE CASTING/ROLLING INSTALLATION

The present application is a 371 of International application PCT/EP2014/050178, filed Jan. 8, 2014, which claims priority of DE 10 2013 224 633.1, filed Nov. 29, 2013, and DE 10 2013 200 438.9, filed Jan. 14, 2013, the priority of these applications is hereby claimed and these applications are incorporated herein by reference.

BACKGROUND OF THE INVENTION

The invention pertains to a casting/rolling installation for producing hot-rolled strip. In addition, the invention pertains to a method for removing and installing rolls in a reducing stand of the casting/rolling installation.

Casting/rolling installations for casting and rolling metal strip are generally known from the prior art. A known type of such a casting/rolling installation is, for example, the so-called "compact strip production" installation. This known type of installation is shown in FIG. 4 and is described below in schematic terms. Additional types of installations are also possible, which means that the example is not to be understood as limiting in any way.

FIG. 4 shows a single-strand casting/rolling installation 100. In it, liquid metal, typically liquid steel, is transported in a tundish 180 by means of a casting bay crane 190 to a distributor device 120, typically a so-called swiveling tundish. From the distributor device 120, the liquid steel is conducted into a first mold 112-1, where it solidifies on the cooled edges of the mold, as a result of which a strand shell is formed. At the outlet of the mold 112-1, the cast strand, which is still liquid on the inside, is sent to a downline roller apron 114-1, which deflects the cast strand emerging vertically from the mold 112-1 into a horizontal plane. As it is being guided along the roller apron 114-1, the cast strand is cooled further until it has completely solidified. After its complete solidification, the cast strand 210-1 passes through a first reducing stand 116-1, which rolls the cast strand and thus reduces its thickness. Seen in the casting direction R, the cast strand then passes through a shears 192, which cuts the strand into slabs 220-1. The shears 192 are typically assigned a scrap box 193 for carrying away the metal scrap which accumulates during the cutting of the cast strand. The shears are also typically followed by a tunnel furnace 194 to hold the slabs at temperature or to increase the temperature of the slabs slightly to the slab rolling temperature required by the following finishing line 195. In the finishing line, the slabs are rolled out into hot-rolled strip 230-1. Downstream from the finishing line 195, a cooling section 196 and a reel device 197 are typically provided, the latter being used to wind up the cooled hot-rolled strip.

In addition to the single-strand installation just described with reference to FIG. 4, multi-strand installations are also known, in which several of the strands shown in FIG. 4 are arranged parallel to each other.

The casting/rolling installation just described with reference to FIG. 4 takes advantage of the heat of casting, which significantly decreases the need to reheat the slabs in the tunnel furnace 194 in comparison with the method of supplying slabs which have already cooled.

For metallurgical reasons, it is favorable to achieve a degree of deformation of the cast strand 210-1 of at least 60-80% from the outlet of the roller apron to the reel device

197, where the hot strip is coiled up. During the production of the thicker grades of hot-rolled strip, slab thicknesses in the range of 40-120 mm are reached. In the case of thicker slabs or thicker hot-rolled strip, it is advantageous for the deformation process to be conducted in several stages. For this purpose, the cast strand is subjected in the previously mentioned reducing stand 116-1 to a first deformation step as soon as it leaves the roller apron 114-1 and thus brought to a thickness which is suitable for the following compact finishing line 195, where the slabs are brought to their final, desired thickness.

From an energy standpoint, it is logical to conduct the first deformation step immediately after casting. To realize this, the first reducing stand 116-1 is set up directly behind the outlet of the roller apron 114-1 and thus under the casting platform 118-1 of the casting/rolling installations 100. The casting platform, as shown in FIG. 4, is typically set up as a horizontal work platform at the level of the mold 112-1. On the casting platform, teams of operators must perform maintenance jobs in particular on the distribution device 120, and tools and consumable materials are also stored on the casting platform. For reasons of occupational safety, the casting platform is configured as a closed but easily walkable work zone. The entire casting installation is operated by one person from a control stand 198, which, as shown by way of example in FIG. 4, is arranged above the casting platform.

The arrangement of the first reducing stand 116-1 directly after the roller apron and underneath the casting platform 118-1 just described as being advantageous with respect to energy use suffers from the disadvantage that the casting bay crane 190 traveling above the casting platform 118-1 cannot access the reducing stand 116-1. In particular, the casting bay crane 190 therefore cannot be used to change the rolls 310, 320-1, 320-2 of the reducing stand 116-1. This is also true for the reason that the operator in the control. stand 198, from which the movement of the casting bay crane 190 is controlled, has no view of the area where the reducing stand 116-1 is installed, because this view is blocked by the casting platform 118-1.

It must also be taken into account that the operating teams on the casting platform and the operating teams underneath the casting platform in the area of the outlet from the roller apron typically have neither visual nor spoken contact with each other, so that work being carried out in parallel by the two teams can lead under certain circumstances to hazardous situations.

One possible way of changing the rolls in the reducing stand 116-1 underneath the casting platform 118-1 could consist in providing a separate crane underneath the casting platform. Such a crane, however, would require considerable investment, and in addition the height of the installation or of the casting platform may not always be sufficient to allow the crane to be operated there usefully. The need to elevate the casting platform in these cases would also necessarily be associated with considerable cost.

In the prior art, there is a wide variety of known roll-changing devices for removing and carrying away worn-out rolls from a reducing stand and for bringing up and installing new rolls in the stand. Among others, roll-changing devices in the form of a turntables are also known. Such turntables are known specifically from, for example, German Offenlegungsschrift No. DE 1 527 622; German Patent No. 851941; and Patent DE 693 224, published by the Patent Office of the German Reich. The last-mentioned patent discloses a rotating table, which can be turned by a drive. A track for accepting sets of rolls is arranged on the turntable. At the periphery of the turntable, there is typically an intermediate holding station for the rolls, which comprises track spurs, arranged in a star-like manner, connecting to the track on the turntable. A device is provided on the turntable to push a set of rolls from the intermediate holding station onto or up to the turntable and vice versa to push a set of rolls off the turntable and onto the holding station. The track spurs on the holding station allow individual rolls or a complete set of rolls, after they have been removed from the roll stand, to be deposited on a track spur and for a second set to be moved into position immediately in the roll stand without the need for a crane. The same device, which can be operated hydraulically, for example, is also adapted to bring new rolls into position opposite the roll stand and then to push the rolls into the stand and vice versa to pull worn-out rolls back out of the stand.

U.S. Pat. No. 1,833,376, furthermore, discloses a roll-changing device in the form of a turntable, which can be locked in certain rotational positions and thus prevented from rotating further.

SUMMARY OF THE INVENTION

Against the background of this prior art, the invention is based on the goal of improving a known casting/rolling installation and known methods for removing and installing rolls in the rolling stands of these installations in such a way that the investment costs for a roll-changing device for changing the rolls are reduced, whereas, at the same time, a roll change can be carried out easily and reliably, in particular in the case of a reducing stand downline from the roller apron.

This goal is achieved, in the case of a casting/rolling installation with a first casting line and, parallel to that, a second casting line, in that the first and second reducing stands are set up in such a way that their operating sides are located in the intermediate space between the two casting lines, and in that the roll-changing device is configured in the form of a turntable and is arranged in the intermediate space between the two casting lines at the level of and between the two reducing stands.

The claimed turntable between the first and second casting lines offers the advantage that, thanks to its presence, only one roll-changing device is needed to change the rolls of both reducing stands of the casting lines. It is thus no longer necessary to provide separate roll-changing devices, one for each rolling stand, in particular for each reducing stand. This decreases the investment costs. A roll change can be carried out by means of the turntable easily and reliably; in particular, changing the rolls in this way has no effect on the work being carried out on the casting platform.

The term "operating side" of a rolling stand refers to the side of the rolling stand, transverse to the rolling direction, on which in particular the roll changes are performed. The opposite side of the rolling stand is called the "drive side"; on this side, the drives for the rolls, i.e., motors, gearboxes, and drive spindles, are typically arranged, for which reason these drive sides are typically inaccessible and in particular are not suitable for a roll-changing operation.

The term "backup roll" in the present description means not only the actual backup rolls themselves but possibly also any intermediate rolls which may be present in six-high stands. The phrase "additional rolls" also used here can mean in particular the actual backup rolls or intermediate rolls.

According to a first exemplary embodiment, the casting/rolling installation according to the invention comprises a casting bay, in which, among other things, the molds, the roller aprons, the reducing stands of the two casting lines, and a casting bay crane are arranged; the installation also comprises, next to the casting bay, an adjacent bay, connected to the casting bay in the casting direction, which also comprises a crane. The adjacent bay can be for example, a furnace bay or a rolling bay.

For the arrangement of the turntable between the two casting lines, there are in principle three possible variants. According to a first variant, the turntable can be located between the two casting lines in such a way that at least a partial area of the turntable is accessible to the casting bay crane or to the crane of the adjacent bay. Alternatively, the turntable can be completely covered or roofed by, for example, the casting platform, so that neither the casting bay crane nor the crane of the adjacent bay can access the turntable. In the case of this second variant, it is therefore necessary to provide an intermediate holding station for the rolls of the first and second reducing stands in the adjacent bay between the two casting lines and—looking in the casting direction—downstream from the turntable, preferably directly at its periphery. In contrast to the turntable, the intermediate holding station is not roofed, in particular not covered by the casting platform; on the contrary, because of the way it is arranged in the adjacent bay, it is accessible to the crane of the adjacent bay. In concrete terms, the crane of the adjacent bay thus serves to deliver new rolls to the intermediate holding station and to carry away the worn-out rolls from the holding station. According to a third variant, a combination of the two first-mentioned variants is also possible, according to which a partial area of the turntable is accessible either to the casting bay crane or to the crane in the adjacent bay, and in addition the intermediate holding station is accessible to the crane in the adjacent bay.

The turntable is stationary; that is, it cannot be moved in a translational manner. Its rotational axis remains permanently in place.

It is advantageous for the first and second reducing stands to be on the same level as the first and second casting lines, so that the vertical center planes of the two stands coincide. The turntable is then preferably arranged between the two casting lines in such a way that its stationary vertical rotational axis lies in the coinciding center planes of the first and second reducing stands. It is then possible for the turntable to serve the reducing stands in both casting lines in the same way.

The radius of the turntable is advantageously configured in such a way that the periphery of the turntable reaches all the way to the first and second reducing stands, namely, to the operating sides of each stand. This offers the advantage that there is no need to bridge a gap between the turntable and the rolling stands. The first reducing stand is advantageously directly downstream, with respect to the casting direction, from the outlet of the first roller apron, and the second reducing stand is advantageously also directly downstream, with respect to the casting direction, from the outlet of the second roller apron. As a result of this close arrangement of the reducing stands at the outlets of the roller aprons, it is guaranteed that, for this purpose of reducing the thickness of the cast strand, optimal use can be made of the casting heat of the cast strand. To this extent, this arrangement serves as a way of reducing energy consumption.

A pulling and pushing device, e.g., in the form of a roll-changing locomotive or a hydraulic cylinder, is preferably provided on the turntable. The pushing and pulling device serves to pull the rolls out of the first and/or second reducing stand and onto the turntable, to push the rolls from the turntable into the first and/or second reducing stand, or to move or transfer the rolls between the turntable and the intermediate holding station.

Providing an opening in the area of the rotational axis of the turntable or providing a vertically oriented tubular configuration in the area of the rotational axis offers the advantage that power or media lines can be passed from the floor or foundation of the casting/rolling installation to the pushing and pulling device on the turntable.

The turntable advantageously comprises an upper level with positions for receiving the work rolls, for example, and a lower level with positions for receiving additional rolls, e.g., the backup rolls, from at least one of the two reducing stands of the two casting lines. This configuration offers the advantage that not only individual rolls but also entire sets of rolls, possibly together with a roll-change stand, can find room simultaneously on the turntable.

In principle, each of the two casting lines can comprise its own casting platform, wherein it is also conceivable that an intermediate space between the two casting platforms could be present above the intermediate space between the two casting lines. Into this intermediate space, it would be possible, for example, to drive the casting bay crane so that it can access at least partial areas of the turntable. It is also possible to combine the two casting platforms into common casting platform, which then also extends transversely to the casting direction and spans the gap between the two casting lines. The casting lines are each configured as casting/rolling installations, as described above by way of example in the form of "compact strip production" installations in the introduction with reference to FIG. 4.

The goal of the invention described above is also achieved by the methods for removing rolls from, and installing rolls in, the reducing stands of the casting/rolling installation according to the invention. The advantages of these methods correspond to the advantages cited above with reference to the claimed casting/rolling installation.

Four figures in all are attached to the description, wherein:

DETAILED DESCRIPTION OF THE INVENTION

The invention is described in detail below in the form of exemplary embodiments with reference to figures cited above. The same technical elements are designated by the same reference numbers in all of the figures.

Figure 1:
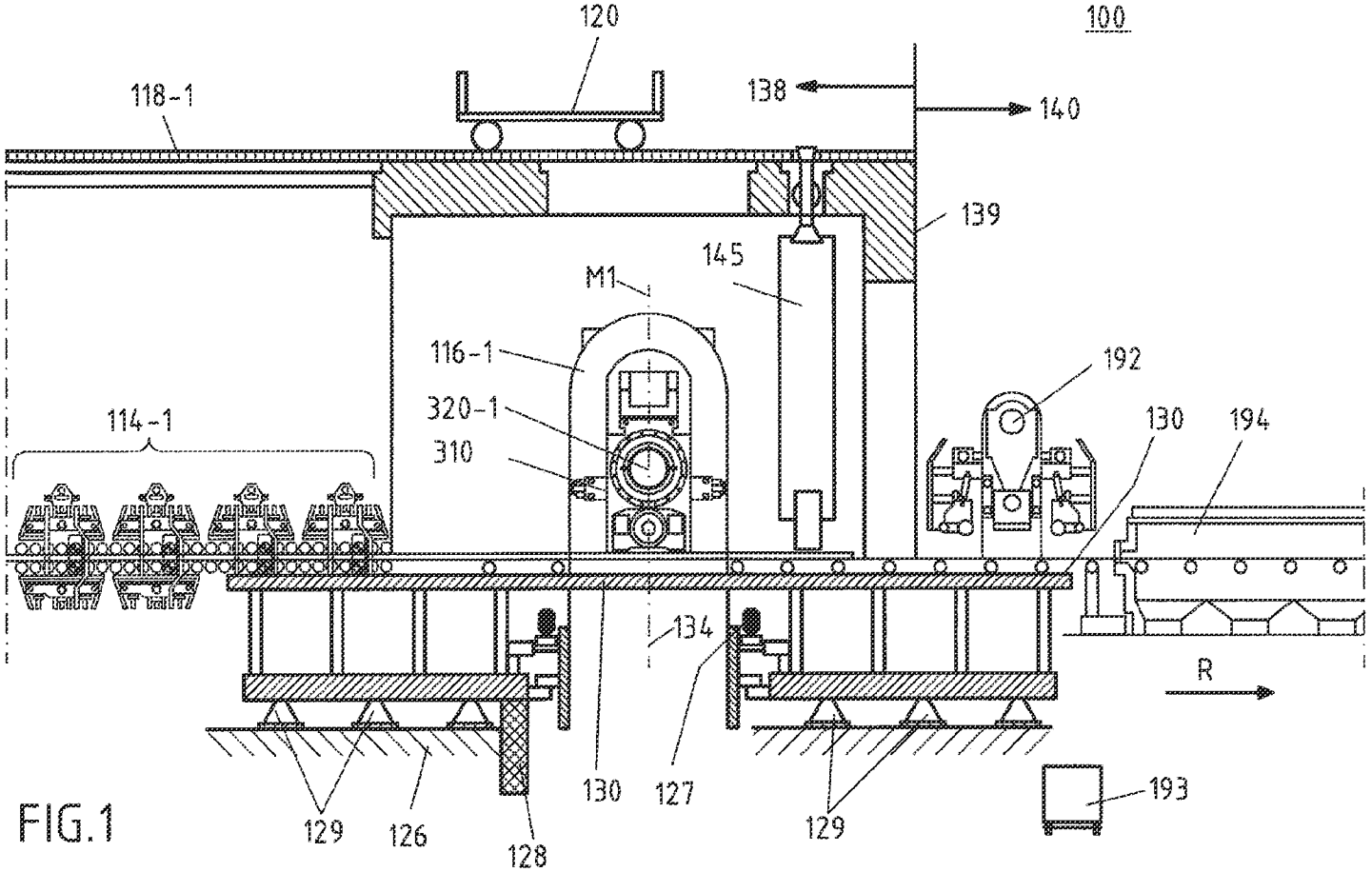
FIG. 1 shows a longitudinal cross section through the turntable between two lines of the casting/rolling installation according to the invention, with a view toward a casting line.
Figure 4:
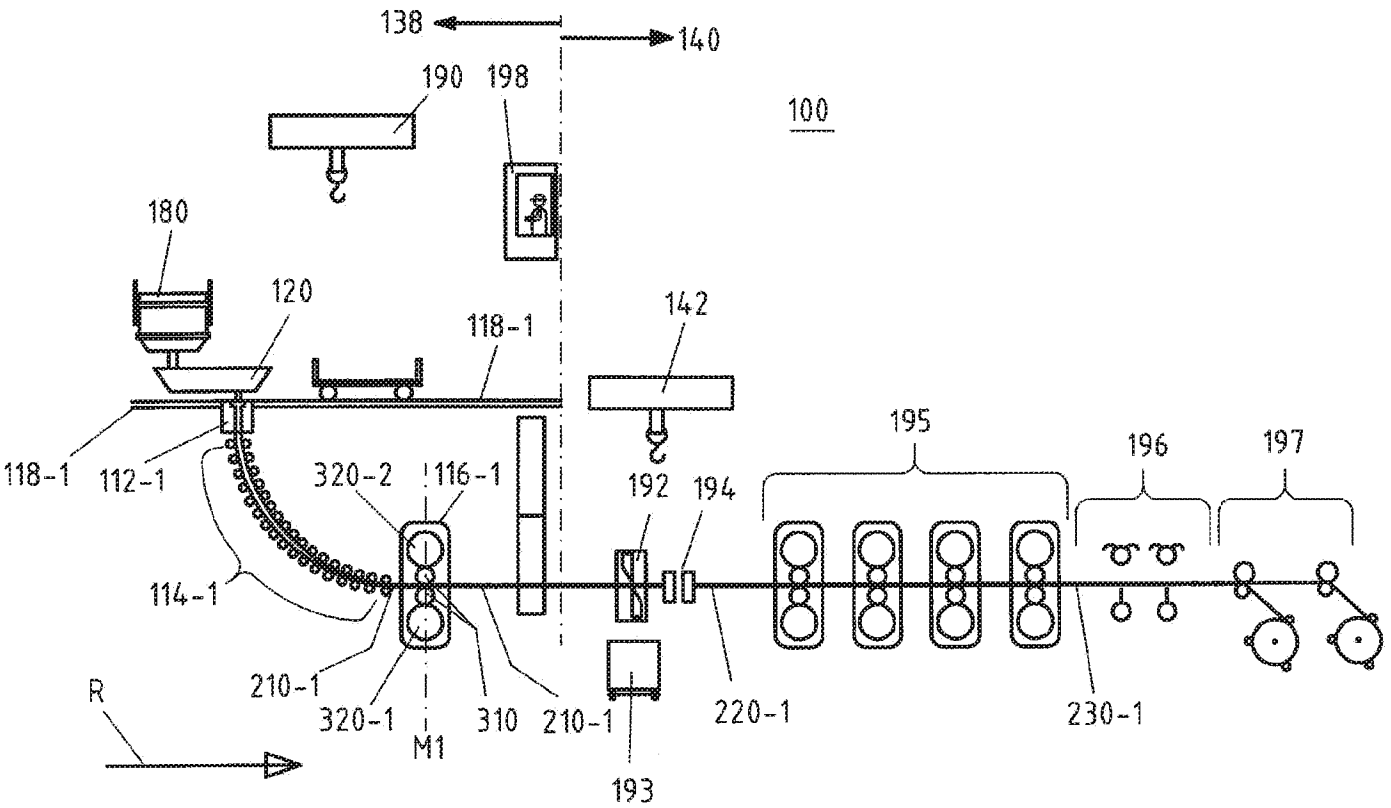
FIG. 4 PRIOR ART
FIG. 4 shows a casting/rolling installation according to the prior art.

FIG. 1 shows a longitudinal cross section through the casting/rolling installation 100 according to the invention. It is a part of the general casting/rolling installation previously described with reference to FIG. 4, but supplemented by the turntable 130 according to the invention. Specifically, FIG. 1 shows a casting bay 138, to which, seen in the casting direction R, an adjacent bay 140 is connected. The boundary between the two bays coincides in FIG. 1 with the outer edge of the first casting platform 118-1; this boundary is indicated in FIG. 1 by the reference number 139. On the casting platform, the tundish device 120 in the form of a movable distributor can be seen. On the left edge of the figure, furthermore, the tail of a roller apron 114-1 can be seen, downline from which, in the casting direction R, a first reducing stand 116-1 is located. Downstream in turn from the reducing stand is a device 145 for removing the cold strand. This cold strand-removing device 145, as shown in FIG. 1, is also located, like the first roller apron 114-1 and the first reducing stand 116-1, underneath the first casting platform 118-1. All these devices are therefore inaccessible to a casting bay crane, which is typically located above the casting platform. Again looking in the casting direction we can see, downstream from the cold strand-removal device, the shears 192 and a tunnel furnace 194 in the adjacent bay 140. The shears 192 are provided with a scrap box 193. FIG. 1 also shows, in longitudinal cross section, the roll-changing device according to the invention in the form of a turntable 130. Its stationary rotational axis 134 preferably coincides, as shown in FIG. 1, with the vertical center plane M1 of the first reducing stand 116-1. It is also possible to see that the turntable is held and rotatably supported by a turntable bearing 129 on a foundation 126. The rotational movement of the turntable 130 around its vertical rotational axis 134 is accomplished by means of a turntable drive 127. Locking devices or indexing devices 128 are provided to lock the turntable 130 in predetermined rotational positions.

Figure 2:
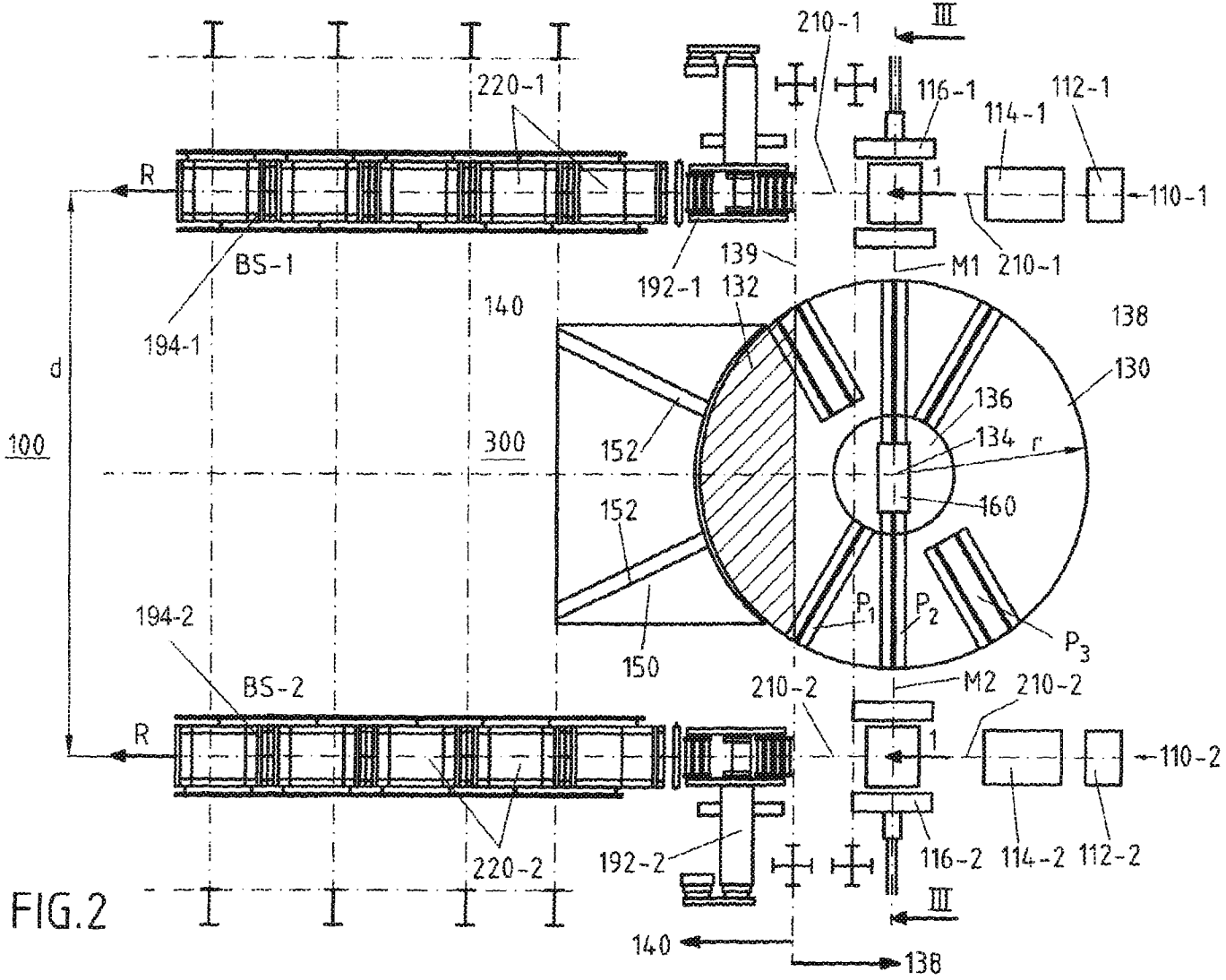
FIG. 2 shows a top view of the casting/rolling installation according to the invention with first and second casting lines (other possible casting lines are not shown)

FIG. 2 shows a top view of the casting/rolling system 100. The first casting line 110-1 and, parallel to that, a second casting line 110-2 can be seen. The casting lines are spaced a certain distance apart. The casting direction R proceeds in FIG. 2 from right to left. The first mold 112-1, the first roller apron 114-1, the first reducing stand 116-1, the first shears 192-1, and the first tunnel furnace 194-1 of the first casting line 110-1 are shown schematically. In the first shears 192-1, the incoming cast strand 210-1 is cut into slabs 220-1. The parallel second casting line 110-2 is built analogously with like components being indicated with the same reference numerals followed by "-2".

Between the two casting lines, the turntable 130 according to the invention can be seen The stationary rotational axis 134 of the turntable 130 lies in the vertical center planes M1 and M2 of the first and second reducing stands 116-1, 116-2; because of the symmetric arrangement of the individual components of the casting lines, these two planes coincide. In concrete terms, the two center planes M1 and M2 coincide because the first and second reducing stands 116-1, 116-2 are on the same level in the casting direction R. it can be seen that the turntable 130 comprises various positions P1, P2, P3 for accepting the rolls of the first or second reducing stand 116-1, 116-2. A pushing and pulling device 160 in the form of, for example, a roll-changing locomotive or a hydraulic cylinder can be arranged in the center of the turntable to move the rolls. It is also possible to see an opening 136 in the center of the turntable; this opening can serve to allow the passage of media lines or power lines for supplying the pushing and pulling device. The boundary between the casting bay 138 and the adjacent bay 140 is also designated in FIG. 2 by the reference number 139. It can be seen that, in the case of the exemplary embodiment according to FIG. 2, a partial area, more precisely a segment, of the turntable always projects into the adjacent bay 140. This segment is designated in FIG. 2 by the reference number 132. Because this segment projects into the adjacent bay 140, it is accessible to the crane of the adjacent bay, so that this crane can carry away worn-out rolls from the segment-shaped area of the turntable 130 to, for example, a roll workshop or can set down new rolls from the roll workshop onto the segment area 132 of the turntable. A pushing and pulling device 160 can be seen. on the turntable 130; it is supported on rails above the opening 136.

FIG. 2 also shows the intermediate holding station 150, which, with respect to the casting direction R, is preferably located right at the periphery of the turntable. The intermediate holding station 150 preferably comprises for its own part rail spurs 152 oriented toward the rotational axis 134 of the turntable, on which rail spurs the rolls of the two reducing stands 116-1, 116-2 can be stored on an intermediate basis. The radial orientation of the rail spurs to the center of rotation 134 of the turntable offers the advantage that the rolls can be pushed from the turntable onto the intermediate holding station and vice versa.

Figure 3:
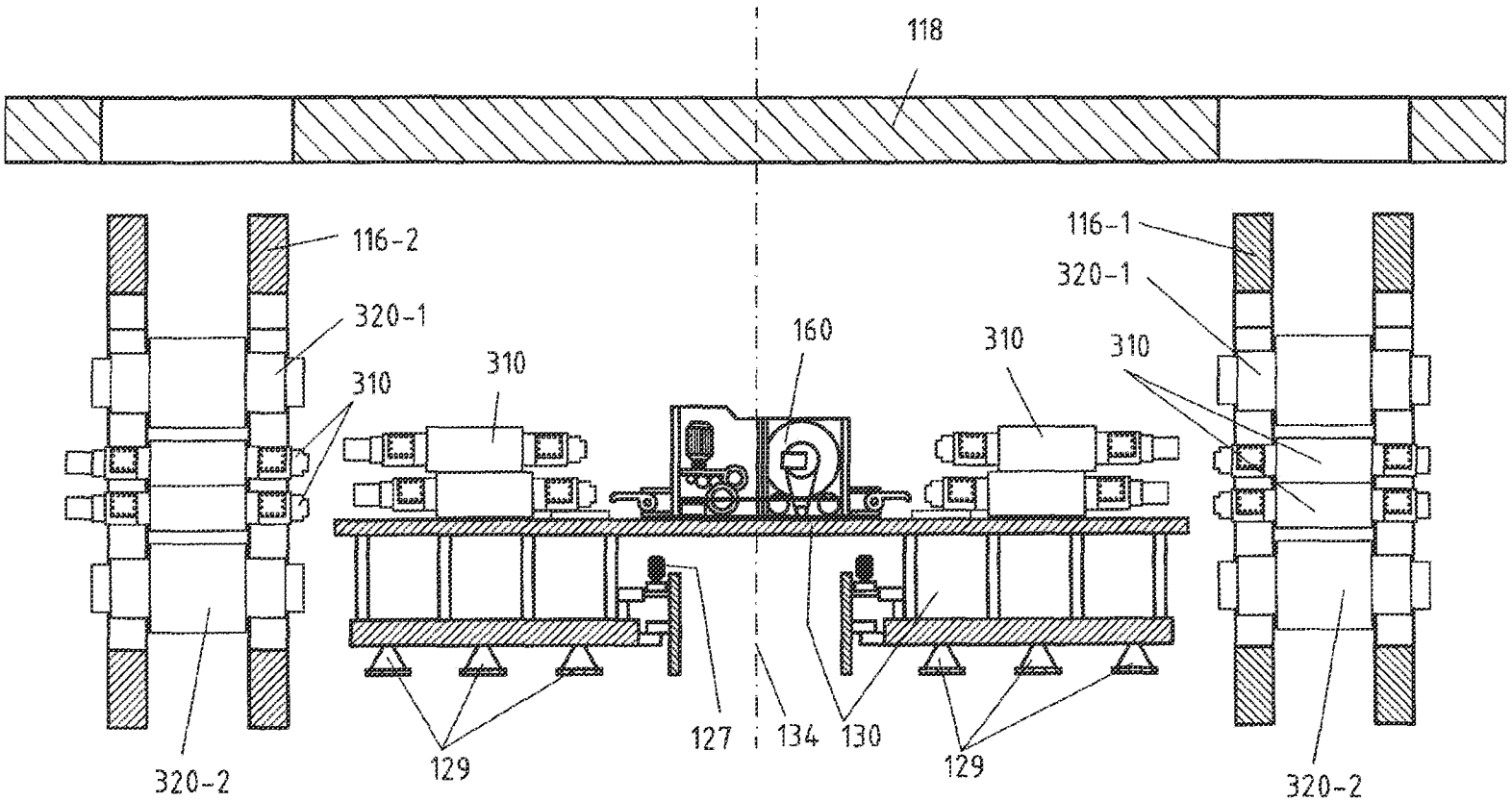
FIG. 3 shows a cross section through the casting/rolling installation according to the invention at the level of the center planes of the two reducing stands.

FIG. 3 shows by way of example a cross section through the casting/rolling installation 100 according to the invention at the level of the common center planes M1, M2 of the first and second four-roll reducing stands 116-1, 116-2. It can be seen that the two reducing stands 116-1, 116-2 comprise, by way of example, two work rolls 310, an upper backup roll 320-1, and a lower backup roll 320-2. Between the two reducing stands, the turntable 130 according to the invention can be seen in cross section, on which, by way of example, sets of work rolls 310 have been laid. In the center of the turntable 130 is the previously mentioned pushing and pulling device 160.

A change of rolls, more precisely, the removal of work and backup rolls from, and the installation of such rolls in, the reducing stands 116-1, 116-2 cited by way of example is carried out in the casting/rolling installation according to the invention just described according to the following method:

The method for removing at least one of the worn-out work rolls 310 from one of the two reducing stands 116-1, 116-2 of the casting/rolling installation 100 comprises the following steps:

14a) turning the turntable 130 so that a free second position P2 on the turntable for receiving the worn-out work roll is positioned opposite the first or second reducing stand 116-1, 116-2;

14b) pulling the at least one worn-out work roll 310 by means of the pushing and pulling device 160 out of the first or second reducing stand and onto the turntable 130 in the second position P2;

14c) turning the turntable so that the second position P2, which is holding the at least one worn-out work roll 310, is opposite the intermediate holding station 150;

14d) pulling or pushing the at least one worn-out work roll 310 from the turntable 130 onto the intermediate holding station 150; and 14e) transporting the worn-out work roll 310 away from the intermediate holding station 150 by means of the crane 142 of the adjacent bay 140 to a roll workshop;

or alternatively to steps 14(d) and 14(e), when a partial area of the turntable 130 is accessible to the casting bay crane or the crane of the adjacent bay:

14d') transporting the worn-out work roll 310 away from the turntable by means of the casting bay crane or the crane of the adjacent bay.

At least one new work roll 310 is installed in the reducing stand 116-1, 116-2 of the casting/rolling installation by means of the following steps:

15a) performing at least steps 14(a) and 14(b), optionally also steps 14(c) and 14(d);

15b) setting the at least one new work roll 310 by means of the crane of the adjacent bay 140 onto the intermediate holding station 150;

15c1) turning the turntable 130 so that a first position P1 for receiving the at least one new work roll 310 is opposite the intermediate holding station 150; and 15c2) pulling or pushing the at least one new work roll 310 by means of the pushing and pulling device 160 from the intermediate holding station until it lies completely in the first position P1 on the turntable;

15d) turning the turntable so that the first position, which is occupied by the at least one new work roll 310, is opposite the first or second reducing stand 116-1, 116-2, from which the at least one worn-out work roll had been previously removed;

15e) pushing the at least one new work roll 310 by means of the pushing and pulling device 160 into the reducing stand 116-1, 116-2;

or alternatively to steps 15b)-15c2), when a partial area of the turntable is accessible to the casting bay crane or to the crane of the adjacent bay:

15b') turning the turntable 130 so that a first position P1 on the turntable for receiving the at least one new work roll 310 is accessible to the crane 142 of the adjacent bay;

15c') setting the at least one new work roll 310 by means of the casting bay crane or the crane 142 of the adjacent bay 140 onto the first position on the turntable.

The method for removing additional worn-out rolls such as backup rolls 320-1, 320-2 from a reducing stand 116-1, 116-2 of the casting/rolling installation comprises the following steps:

16a) positioning a roll-change stand on the turntable 130;

16b) turning the turntable so that a free third position P3 on the turntable for receiving the worn-out backup rolls is opposite the first or second reducing stand 116-1, 116-2;

16c) pulling out the lower backup roll 320-1 from the reducing stand and into the third position P3 on the turntable 130;

16d) setting the backup roll-changing stand onto the worn-out lower backup roll 320-1 in the third position P3;

16e) moving the worn-out lower backup roll 320-1 together with the backup roll-changing stand set on top into the reducing stand 116-1, 116-2;

16f) in the reducing stand: setting the worn-out upper backup roll 320-2 onto the backup roll-changing stand;

16g) pulling out the upper and lower backup rolls by means of the backup roll-changing stand from the reducing stand and into the third position P3 on the turntable 130;

16h) turning the turntable 130 so that the third position is opposite the intermediate roll holding station 150;

16i) pushing or pulling the backup roll-changing stand with the two backup rolls from the turntable onto the intermediate holding station 150; and 16j) carrying away the upper backup roll 320-2, the backup roll-changing stand, and the lower backup roll 320-1 in succession by means of the crane 142 of the adjacent bay from the intermediate holding station;

or alternatively to steps 16h)-16i), when a partial area of the turntable 130 is accessible to the casting bay crane or to the crane of the adjacent bay:

16j') carrying away the upper backup roll 320-2, the backup roll-changing stand, and the lower backup roll

320-1 in succession by means of the casting bay crane or the crane of the adjacent bay to the roll workshop.

Step 16c) and the following steps are not carried out until after the two work rolls 310 have been removed from the reducing stand 116-1, 116-2.

If, during the course of step 15a), the backup roll-changing stand has already been moved into the third position P3 on the turntable 130, it is raised prior to the performance of step 16c) and, after the completion of step 16c), lowered during the course of step 16d) onto the worn-out lower backup roll.

The method for installing new backup rolls 320 into a reducing stand 116-1, 116-2 of the casting/rolling installation 100 is carried out by means of the following steps:

19a) transporting a new lower backup roll 320-1 to the intermediate holding station 150 by means of the crane 142 of the adjacent bay;

19b) setting the backup roll-changing stand onto the new lower backup roll 320-1 on the intermediate holding station 150 by means of the crane 142 of the adjacent bay;

19c) placing a new upper backup roll 320-2 onto the backup roll-changing stand by means of the crane 142 of the adjacent bay;

19d) pulling or pushing the backup roll-changing stand together with the lower and upper backup rolls from the intermediate holding station to the third position P3 on the turntable 130;

19e) turning the turntable so that the third position P3 is opposite the first or second reducing stand 116-1, 116-2;

19f) pushing the backup roll-changing stand together with the lower and upper backup rolls 320-1, 320-2 into the reducing stand 116-1, 116-2;

19g) lifting the upper new backup roll from the roll-changing stand and suspending the upper backup roll in the reducing stand;

19h) pulling the lower backup roll 320-1 together with the backup roll-changing stand resting on top out of the reducing stand 116-1, 116-2;

19i) lifting the backup roll-changing stand from the lower backup roll and depositing it on the turntable 130;

19j) pushing the new lower backup roll into the reducing stand and installing it there;

or alternatively to steps 19a)-19d), when a partial area of the turntable is accessible to the casting bay crane or to the crane of the adjacent bay:

19a') transporting a new lower backup roll 320-1 onto the turntable by means of the casting bay crane or the crane of the adjacent bay;

19b') setting a backup roll-changing stand onto the new lower backup roll on the turntable by means of the casting bay crane or the crane of the adjacent bay; and 19c') setting a new upper backup roll 320-2 onto the backup roll-changing stand by means of the casting bay crane or the crane of the adjacent bay.

When any of the methods described above is carried out, the sequence of the individual method steps can, in principle, be varied in any way desired; it is necessary only that the sequence make technical sense. All of the pulling or pushing movements of the work rolls or backup rolls can be carried out by means of the pulling and pushing device.

LIST OF REFERENCE SYMBOLS

100 casting/rolling installation
110-1 first casting line
110-2 second castling line
112-1 first mold
112-2 second mold
114-1 first roller apron
114-2 second roller apron
116-1 first reducing stand
116-2 second reducing stand
118-1 first casting platform
118 common casting platform
120 distributor device
126 foundation
127 turntable drive
128 locking or indexing device
129 turntable bearing
130 roll-changing device, turntable
132 partial area, e.g. a segment
134 rotational axis
136 opening
138 casting bay
140 adjacent bay
142 crane of the adjacent bay
145 cold strand removal device
150 intermediate holding station
152 rail spur on the intermediate holding station
160 pulling and pushing device
180 tundish
190 casting hall crane
192-1 first shears
192-2 second shears
193 scrap box
194 tunnel furnace
194-1 first tunnel furnace
194-2 second tunnel furnace
195 finishing mill
196 cooling section
197 reel device
198 control stand
210-1 first cast strand
210-2 second cast strand
220-1 slabs of the first casting line
220-2 slabs of the second casting line
230-1 hot-rolled strip of the first casting line
300 intermediate space
310 work roll
320-1 upper backup roll
320-2 lower backup roll
BS1, BS2 operating sides
d distance
R casting direction
r radius
M1, M2 center planes
P1, P2, P3 positions

The invention claimed is:

1. A casting/rolling installation for producing hot-rolled strip, with:

a first casting line comprising a first mold for producing a first cast strand;

a first roller apron downstream, with respect to a casting direction, from the first mold for deflecting the cast strand from the vertical to a horizontal plane;

a first reducing stand for reducing the thickness of the first cast strand; and a first casting platform, which at least partial covers the first roller apron and at least parts of the first reducing stand;

a second casting line comprising a second mold for producing a second cast strand;

a second roller apron downstream, with respect to the casting direction, from the second mold for deflecting the second cast strand from the vertical to a horizontal plane;

a second reducing stand for reducing a thickness of the second cast strand; and a second casting platform, which at least partially covers the second roller apron and at least parts of the second reducing stand;

at least one distributor device for supplying the first and second molds with liquid metal; and a roll-changing device for changing the rolls of the first and second reducing stands;

wherein the two casting lines are arranged parallel to, and a certain distance away from, each other;

wherein the first and second reducing stands are installed in such a way that their operating sides are located in an intermediate space between the two casting lines; and the roll-changing device is configured in the form of a turntable and is arranged in the intermediate space between the two casting lines at a level of and between the two reducing stands.

2. The casting/rolling installation according to claim 1, comprising a casting bay, in which the molds, the roller aprons, the reducing stands of the two casting lines, and a casting hall crane are arranged; and by an adjacent bay, also with a crane, adjacent to the casting bay in the casting direction.

3. The casting/rolling installation according to claim 2, wherein the turntable is located between the two casting lines so that at least a partial area of the turntable is accessible to the casting bay crane or to the crane of the adjacent bay.

4. The casting/rolling installation according to claim 2, wherein an intermediate holding station for the rolls of the first and second reducing stands is provided in the adjacent bay between the two casting lines and, with respect to the casting direction, downstream from the turntable, which holding station is accessible to the crane of the adjacent bay, wherein the crane serves to deliver new or reprocessed rolls to the intermediate holding station and to carry away worn-out rolls from the holding station.

5. The casting/rolling installation according to claim 1, wherein the turntable is configured to rotate around a stationary rotational axis.

6. The casting/rolling installation according to claim 5, wherein the first and second reducing stands are each arranged at the same level in the first and second casting lines in such a way that their vertical center planes coincide; and in that the turntable is arranged between the two casting lines in such a way that its rotational axis lies in the coinciding center planes of the first and second reducing stands.

7. The casting/rolling installation according to claim 1, wherein the radius of the turntable is sized so that the periphery of the turntable extends all the way to the first and second reducing stands.

8. The casting/rolling installation according to claim 1, wherein the first reducing stand is arranged directly downstream, with respect to the casting direction, from the outlet of the first roller apron, and the second reducing stand is arranged directly downstream, with respect to the casting direction, from the outlet of the second roller apron.

9. The casting/rolling installation according to claim 1, wherein a pushing and pulling device in the form of a roll-changing locomotive or a hydraulic cylinder is provided to move the rolls out of the first or second reducing stand and onto the turntable, to move the rolls from the turntable into the first or second reducing stand, or to move the rolls between the turntable (130) and the intermediate holding station, wherein the pulling and pushing device is arranged on the turntable.

10. The casting/rolling installation according to claim 9, wherein the turntable comprises an opening in the area of its rotational axis or has a tubular configuration there to allow a passage of power or media lines to the pushing and pulling device.

11. The casting/rolling installation according to claim 1, wherein the turntable comprises an upper level with positions for receiving the work rolls and a lower level with positions for receiving additional rolls from at least one of the two reducing stands.

12. The casting/rolling installation according to claim 1, wherein the first and second casting platforms are configured as a common casting platform, which stretches across the first and second casting lines transversely to the casting direction.

13. The casting/rolling installation according to claim 1, wherein the first and second casting lines are each configured as a "compact strip production" installation.

14. A method for removing at least one of the worn-out work rolls from one of the two reducing stands of the casting/rolling installation according to claim 1, with the following steps:

14a) turning the turntable so that a free second position on the turntable for receiving the worn-out work roll is positioned opposite the first or second reducing stand;

14b) pulling the at least one worn-out work roll by means of the pushing and pulling device out of the first or second reducing stand and onto the turntable in the second position;

14c) turning the turntable so that the second position, which is holding the at least one worn-out work roll, is opposite the intermediate holding station;

14d) pulling or pushing the at least one worn-out work roll from the turntable onto the intermediate holding station; and 14e) transporting the worn-out work roll away from the intermediate holding station by means of the crane of the adjacent bay to a roll workshop;

or alternatively to steps 14d) and 14e), when a partial area of the turntable is accessible to the casting bay crane or the crane of the adjacent bay:

14d') transporting the worn-out work roll away from the turntable by means of the casting bay crane or the crane of the adjacent bay.

15. A method for installing at least one new work roll in the reducing stand of the casting/rolling installation according to claim 14, with the following steps:

15a) performing at least steps 14a) and 14b), and optionally also 1) steps 14c)-14e) or 2) steps 14c) and 14d');

15b) setting the at least one new work roll by means of the crane of the adjacent bay onto the intermediate holding station;

15c1) turning the turntable so that a first position for receiving the at least one new work roll is opposite the intermediate holding station; and 15c2) pulling or pushing the at least one new work roll by means of the pushing and pulling device from the intermediate holding station until it lies completely in the first position on the turntable;

15d) turning the turntable so that the first position, which is occupied by the at least one new work roll, is opposite the first or second reducing stand, from which the at least one worn-out work roll had been previously removed;

15e) pushing the at least one new work roll by means of the pushing and pulling device into the reducing stand;

or alternatively to steps 15b)-15c2), when a partial area of the turntable is accessible to the casting bay crane or to the crane of the adjacent bay:

15b') turning the turntable so that a first position on the turntable for receiving the at least one new work roll is accessible to the crane of the adjacent bay;

15c') setting the at least one new work roll by means of the casting bay crane or the crane of the adjacent bay onto the first position on the turntable.

16. A method for removing worn-out backup rolls from a reducing stand of a casting/rolling installation according to claim 1, with the following steps:

16a) optionally: positioning, in advance, a backup roll-change stand on the turntable;

16b) turning the turntable so that a free third position on the turntable for receiving the worn-out backup rolls is opposite the first or second reducing stand;

16c) pulling out the lower backup roll from the reducing stand and into the third position on the turntable;

16d) setting the backup roll-changing stand onto the worn-out lower backup roll in the third position;

16e) moving the worn-out lower backup roll together with the backup roll-changing stand set on top into the reducing stand;

16f) in the reducing stand: setting the worn-out upper backup roll onto the backup roll-changing stand;

16g) pulling out the upper and lower backup rolls by means of the backup roll-changing stand from the reducing stand and into the third position on the turntable;

16h) turning the turntable so that the third position is opposite the intermediate roll holding station;

16i) pushing or pulling the backup roll-changing stand with the two backup rolls from the turntable onto the intermediate holding station; and 16j) carrying away the upper backup roll, the backup roll-changing stand, and the lower backup roll in succession by means of the crane of the adjacent bay from the intermediate holding station;

or alternatively to steps 16h)-16i), when a partial area of the turntable is accessible to the casting bay crane or to the crane of the adjacent bay:

16j') carrying away the upper backup roll, the backup roll-changing stand, and the lower backup roll in succession by means of the casting bay crane or the crane of the adjacent bay to the roll workshop.

17. The method according to claim 16, wherein step 16c) and the following steps are carried out only after the two work rolls have been removed from the reducing stand.

18. The method according to claim 16, wherein if the backup roll-changing stand has already been placed in the third position on the turntable during the course of step 16a), it is lifted prior to the performance of step 16c), and after completion of step 16c), is lowered onto the worn-out lower backup roll during the course of step 16d).

19. A method for installing new backup rolls in a reducing stand of a casting/rolling installation according to claim 1, with the following steps:

19a) transporting a new lower backup roll to the intermediate holding station by means of the crane of the adjacent bay;

19b) setting the backup roll-changing stand onto the new lower backup roll on the intermediate holding station by means of the crane of the adjacent bay;

19c) placing a new upper backup roll onto the backup roll-changing stand by means of the crane of the adjacent bay;

19d) pulling or pushing the backup roll-changing stand together with the lower and upper backup rolls from the intermediate holding station to the third position on the turntable;

19e) turning the turntable so that the third position is opposite the first or second reducing stand;

19f) pushing the backup roll-changing stand together with the lower and upper backup rolls into the reducing stand;

19g) lifting the upper new backup roll from the roll-changing stand and suspending the upper backup roll in the reducing stand;

19h) pulling the lower backup roll together with the backup roll-changing stand resting on top out of the reducing stand;

19i) lifting the backup roll-changing stand from the lower backup roll and depositing it on the turntable;

19j) pushing the new lower backup roll into the reducing stand and installing it there;

or alternatively to steps 19a)-19d), when a partial area of the turntable is accessible to the casting bay crane or to the crane of the adjacent bay:

19a') transporting a new lower backup roll onto the turntable by means of the casting bay crane or the crane of the adjacent bay;

19b') setting a backup roll-changing stand onto the new lower backup roll on the turntable by means of the casting bay crane or the crane of the adjacent bay; and 19c') setting a new upper backup roll onto the backup roll-changing stand by means of the casting bay crane or the crane of the adjacent bay.

20. The method according to claim 19, wherein the installation of the new backup rolls is carried out only after the worn-out work rolls and the worn-out backup rolls have been removed from the reducing stand.

* * * * *